US005084992A

United States Patent [19]

Sinykin et al.

[11] Patent Number: 5,084,992

[45] Date of Patent: Feb. 4, 1992

[54] SNOW TILLER WITH COMPACTOR PAN

[75] Inventors: William B. Sinykin, Logan; Mark A. Benson, Wellsville; Scott J. Hales, Logan, all of Utah

[73] Assignee: Logan Manufacturing Company, Logan, Utah

[21] Appl. No.: 688,899

[22] Filed: Apr. 22, 1991

[51] Int. Cl.[5] ..... E01H 5/04; E01H 4/00

[52] U.S. Cl. ..... 37/222; 37/224; 37/241; 172/250

[58] Field of Search ..... 37/196, 269, 221, 222, 37/223, 224, 225, DIG. 13, 241, 242; 172/112, 253, 245, 250, 684.5; 299/24

[56] References Cited

U.S. PATENT DOCUMENTS

| | | | |
|---|---|---|---|
| 3,794,122 | 2/1974 | Rohrer | 37/224 |
| 4,348,825 | 9/1982 | Bächler | 37/224 |
| 4,359,831 | 11/1982 | Beeley | 37/259 |
| 4,523,398 | 6/1985 | Scheibel et al. | 37/222 |
| 4,559,725 | 12/1985 | Wieland et al. | 37/222 |
| 4,651,451 | 3/1987 | Beeley et al. | 37/219 |
| 4,726,129 | 2/1981 | Huag | 37/222 |
| 4,738,037 | 4/1988 | Huag | 37/222 |
| 4,815,223 | 3/1989 | Brandt | 37/224 |
| 4,888,891 | 12/1989 | Huag | 37/222 |
| 4,892,154 | 1/1990 | Ranner | 37/222 |
| 4,897,941 | 2/1990 | Sinykin | 37/222 |

FOREIGN PATENT DOCUMENTS

| | | | |
|---|---|---|---|
| 935284 | 10/1973 | Canada | 37/222 |
| 1350234 | 11/1987 | U.S.S.R. | 37/224 |

OTHER PUBLICATIONS

"Tiller Compactor Bar" flyer, FallLine Inc.

*Primary Examiner*—Dennis L. Taylor
*Assistant Examiner*—Spencer Warnick
*Attorney, Agent, or Firm*—A. Ray Osburn

[57] ABSTRACT

A snow grooming device for ski slopes, being a snow tilling apparatus with a toothed, selectively powered tiller bar, along with a compactor pan which may be releasably attached beneath the tiller bar to convert the device from a tiller into a snow compactor.

10 Claims, 3 Drawing Sheets

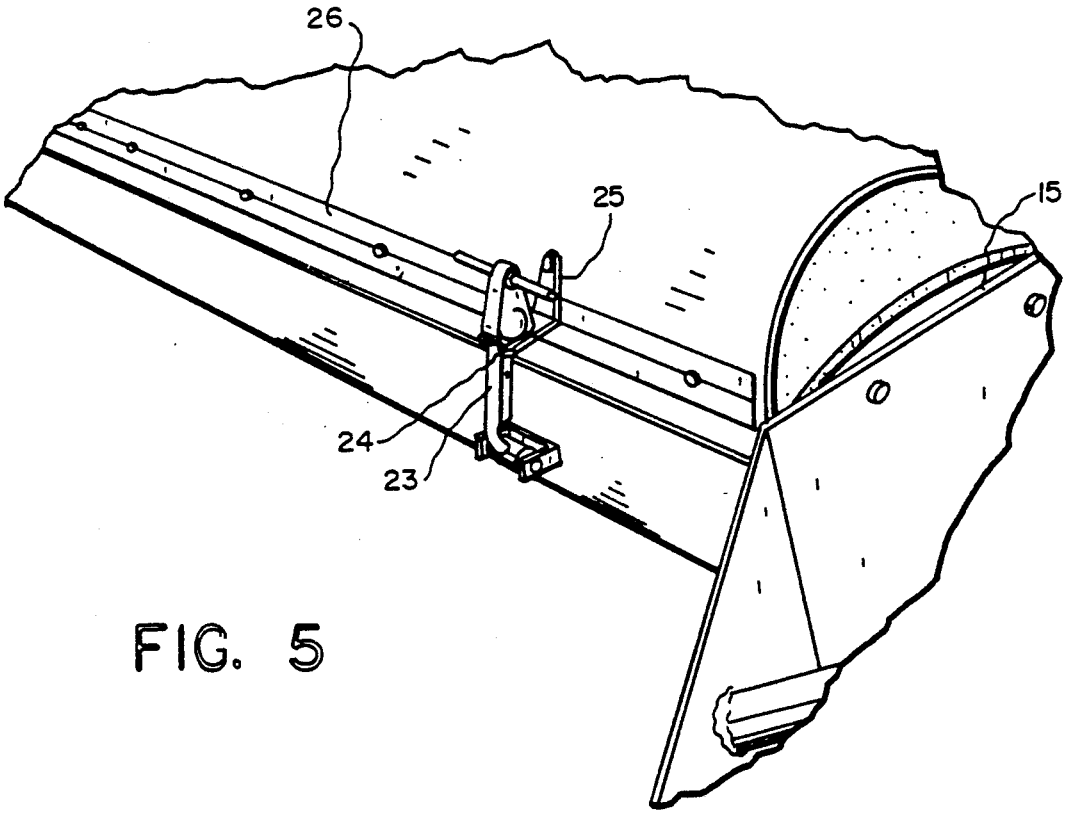
FIG. 5
FIG. 6
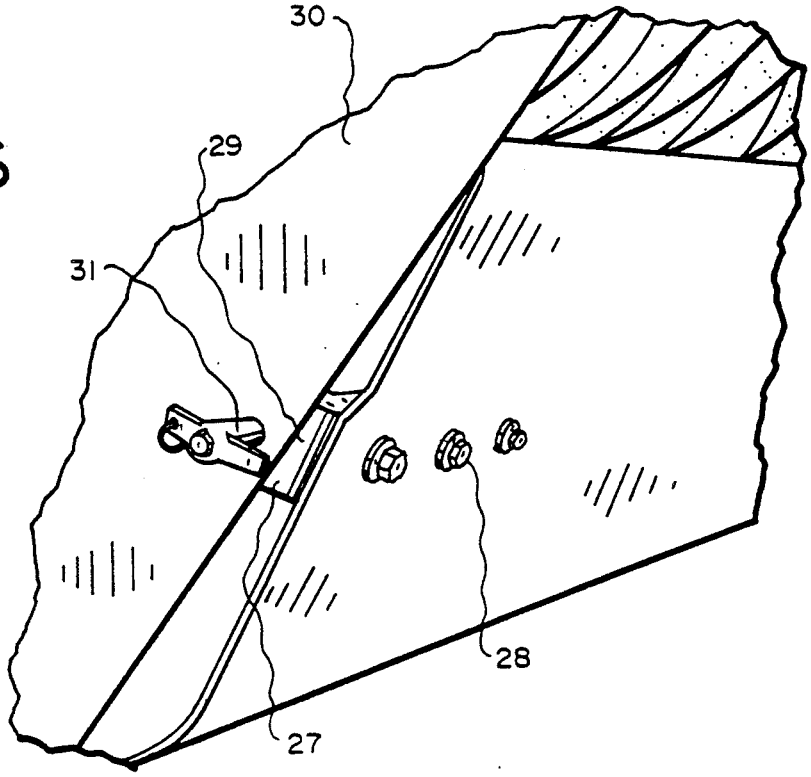

SNOW TILLER WITH COMPACTOR PAN

BACKGROUND OF THE INVENTION

1. Field

The invention is in the field of apparatus for conditioning a path of snow on the ground for skiing and, more particularly, such apparatus for tilling and compacting said path of snow.

2. State of the Art

To condition snow runs for skiing, snow mobiling and the like, it is at times efficient and desirable to compact newly fallen fluffy snow to provide more skiable surfaces and also to prevent such snow from removal by drifting by wind action. Such ski runs often require aggressive breaking up, powdering and leveling of the snow surface, especially after use between falls of fresh snow. Often such tilling of the snow does not result in the best skiable snow condition, even with the use of following smoothing skirts and snow combs commonly included on the snow tillers. Subsequent compacting of the tilled, stirred snow is often desirable, so that both tilling devices and separate compacting devices are commonly used one after the other. Disconnecting a tiller, for example, and connecting a separate compactor, such as disclosed in U.S. Pat. No. 4,651,451, typically entails a round trip of the towing vehicle from the slope to the equipment yard. To avoid loss of time and the double expense of purchase and maintenance of two snow grooming implements, the use of combination devices has been attempted. One example is a tiller with a following snow compacting roller disclosed in U.S. Pat. No. 4,359,831. This approach does not provide the option of compacting prior to tilling, as is often desirable. Nor does it compact as efficiently as do commonly used compactor devices. It also leaves no option for providing corrugated or smoothed final snow surfaces by selected grooming comb designs, such as disclosed in U.S. Pat. No. 4,897,941. One other recent attempt to solve the dual need for tilling and compacting by the same apparatus is represented by the "TILLER/COMPACTOR BAR" shown in the published flyer submitted herewith. A row of downstanding flexible plastic panels is mounted forwardly of the cutter bar. However, this device permits the snow to undesirably pile and pack into the space beneath the covering apron about and above the cutter bar, often militating against a smooth final compacted surface.

Clearly, there is need for an improved solution for converting snow tilling apparatus into compacting apparatus, for more efficient maintenance of ski slopes in desirable skiable condition.

BRIEF SUMMARY OF THE INVENTION

With the foregoing in mind, the present invention eliminates or substantially alleviates the disadvantages of present snow conditioning apparatus for ski runs and the like, by providing such an apparatus which may be easily converted from one to the other to be a tiller or an efficient snow compacting device at the site of snow conditioning operations.

The tiller comprises an elongate cutter bar assembly with outstanding snow cutting teeth, positioned rotatably beneath a snow collecting apron. The apron begins at a leading edge upwardly forward of the cutter bar and extends rearward and downwardly to a horizontal trailing edge behind the bar. Typically, a comb structure is secured to extend rearward from the apron trailing edge to finally condition the snow surface.

For snow compacting, a covering structure, called a compactor pan, is attached below the cutter bar spanning from the leading to the trailing edges of the apron. The pan excludes snow from both the cutter bar and the space below and inside the apron. The snow contacting downward side of the pan is continuous from front to rear and from side to side of the apron, bearing upon and compacting the snow as the apparatus is drawn thereover. The trailing comb, although not basic to the compaction, further works the snow surface into the desired final pattern and appearance. The pan preferably comprises a sheet of smooth, corrosion resistant material, preferably stainless steel. When installed, the compactor pan sheet is curved convexly downward, providing a degree of lateral stiffness for forceful pressure upon the snow for efficient working and compacting. Preferably, the sheet is preformed to its approximate installed shape to facilitate installation. Preferably, quick attachment and detachment type connectors are provided at front and rear edges of the compactor pan sheet. The compactor pan is lightweight and easily carried upon the towing vehicle during tilling operations, for example.

It is therefore the principal object of the invention to provide apparatus whereby snow tillers may be temporarily converted and used on site as efficient snow compactors.

BRIEF DESCRIPTION OF THE DRAWINGS

In the drawings, which represent the best mode presently contemplated for carrying out the invention.

DETAILED DESCRIPTION OF ILLUSTRATED EMBODIMENTS

Figure 1:
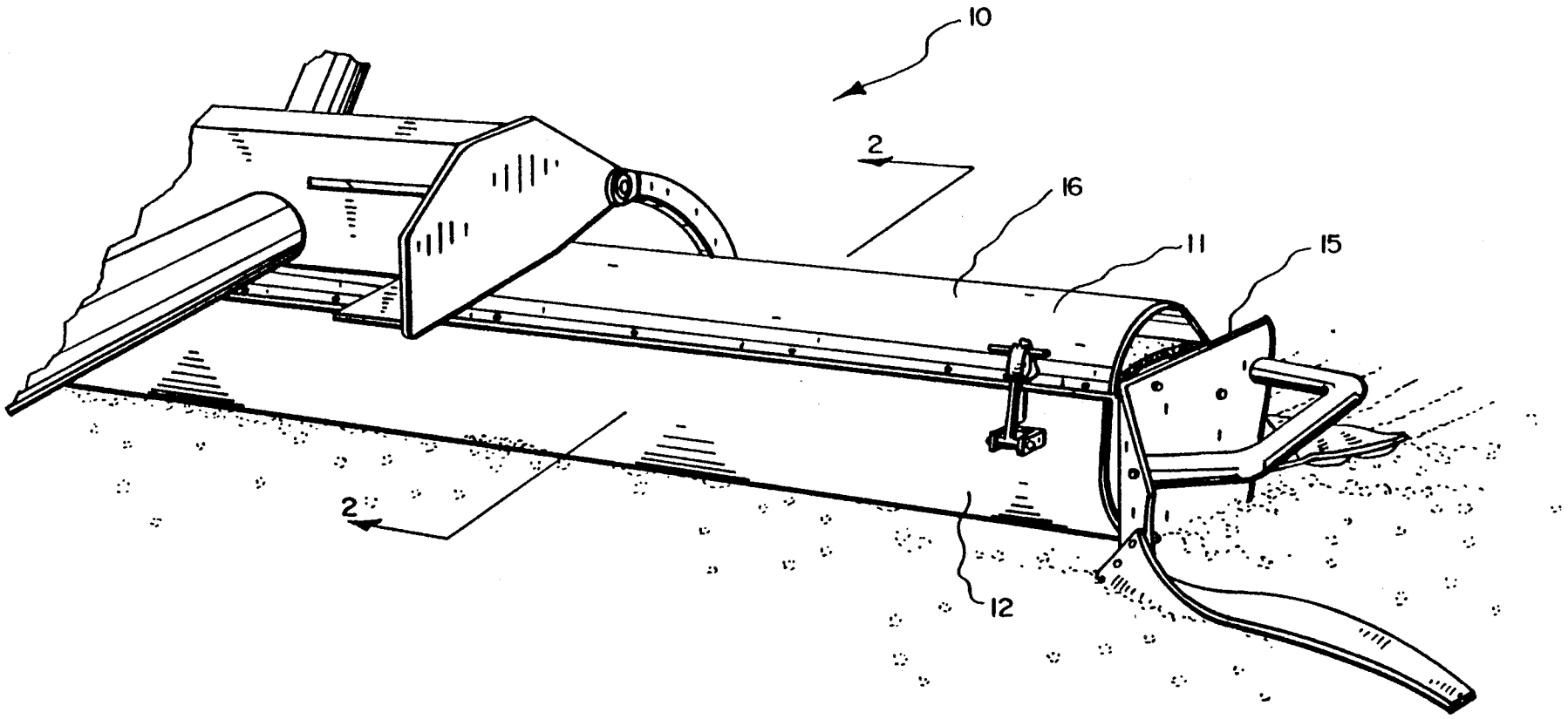
FIG. 1 is a perspective view of a tiller with attached compactor pan in accordance with the invention, drawn to a reduced scale, FIG. 2 a cross sectional view of a fragment of the tiller/compactor pan of FIG. 1, taken along line 2—2 thereof, drawn to a larger scale than FIG. 1, FIG. 3 a perspective view of the compactor pan of the invention detached from the tiller, showing the inside of said pan, drawn to a somewhat smaller scale than FIG. 2, FIG. 4 a perspective view of the compactor pan of FIG. 3, showing the forward portion thereof with quick attach-disconnect toggles, drawn to the scale of FIG. 3, FIG. 5 a perspective view of a fragment of the tiller/-compactor of FIG. 1, showing one of the toggles attaching the forward edge of the pan to the tiller frame, drawn to approximately the scale of FIG. 2, FIG. 6 a perspective view of a fragment of the tiller/-compactor of FIG. 1, showing attachment provisions for the trailing edge of said compactor pan, and FIG. 7 an enlarged view of an end fragment of the trailing edge attachment pin, showing its split ball spring retaining tangs.
Figure 2:
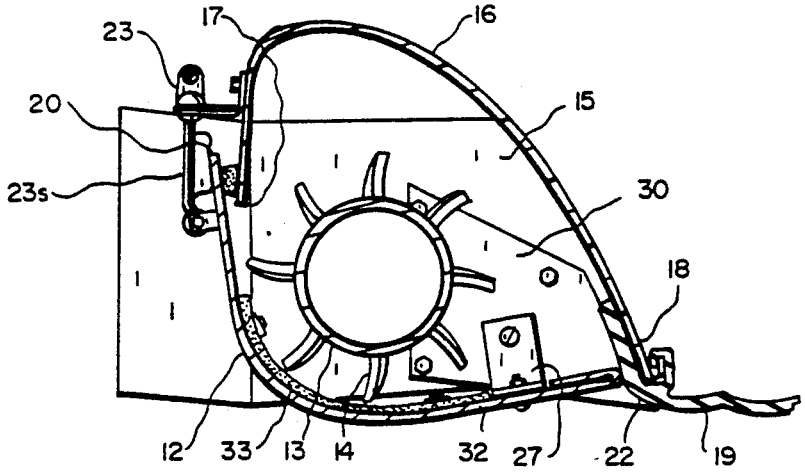
Figure 3:
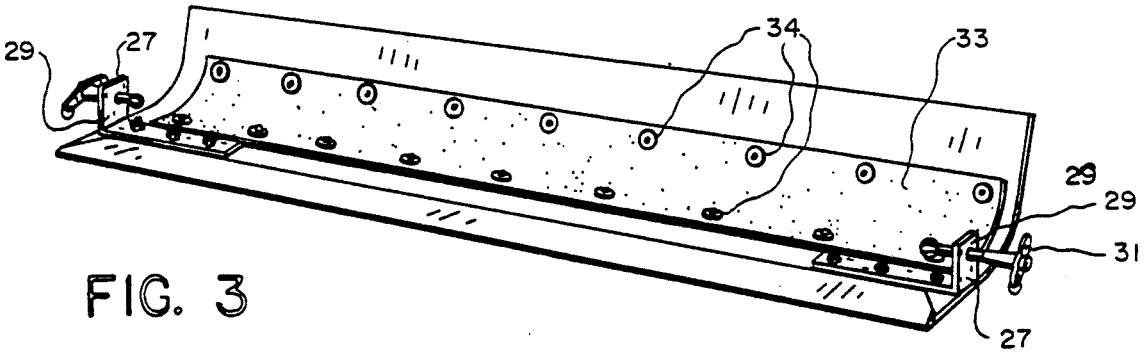
Figure 7:
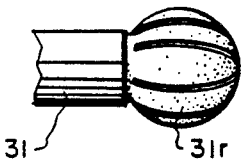
Figure 4:
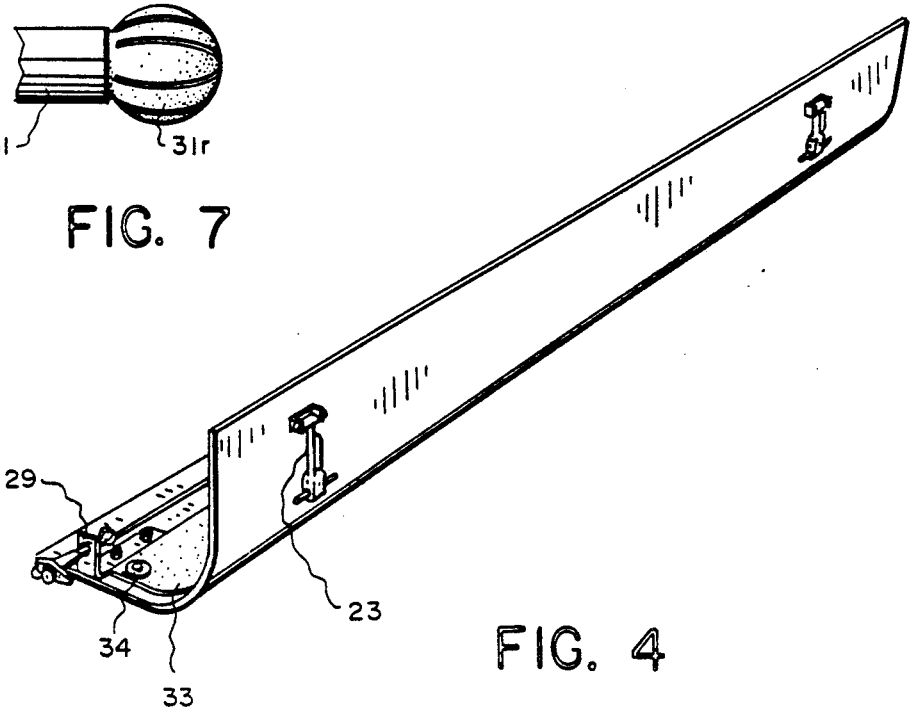

A snow conditioning device 10 in position to be drawn over a path of snow is illustrated in FIG. 1, comprising a snow tiller 11 with an attached compactor conversion pan 12. Tiller 11 has a laterally elongate cutter bar 13 with snow cutting teeth 14, journaled to rotate within tiller frame 15 upon application of rotary power. (FIG. 2) Also mounted upon frame 15 is a covering apron 16 having a leading edge 17 and a trailing edge 18 to which is secured a snow grooming comb 19.

Curving below cutter bar 13 to span between the leading edge 17 and the trailing edge 18 is the compactor pan 12. Pan 12, as well as shielding cutter bar 13 from contact with the snow, effectively closes the bottom opening of apron 16. The snow contacts only the smooth bottom surface of pan 12, not accumulating under apron 16.

Compactor pan 12 is preferably of smooth surfaced stainless sheet 32, curved to be upwardly concave. It is removably attached to frame 15 at its forward edge 20 and near its backfolded rearward edge 21, which is positioned against comb 19 immediately forward of teeth 22. Near each end of leading edge 20 of pan 12, a toggle bolt assembly 23 with elastic strap 23*s* engages a slot 24 in an angled mounting clip 25 secured to a transverse apron mounting member 26 on frame 15. Near its trailing edge 21 at each side, pan 12 carries an L-shaped member 27 secured by nut and bolt assemblies 28. Outstanding legs 29 of member 27 are secured to plates 30 in turn secured to tiller frame 15. "T"-handled retaining pins 31 carry an "orange peel" retaining knob 31*k* with spring leaf tangs 31*t*. (FIGS. 2–7)

As previously indicated, sheet 32 of pan 12 is folded upwardly and rearwardly, so that rear edge 21 is smooth and will not lacerate rubberoid grooming comb 19 when it is installed thereagainst. The curved bottom surface of pan 12 is smoothly continuous from front to rear and from side to side of apron 16, preventing accumulation of snow thereunder. Smoothed and compacted by pan 12, the snow is subsequently further conditioned by comb 19. Preferably, sheet 32 of compactor pan 12 is precurved permanently to be concave upward into approximately its installed shape, to facilitate attachment. During operation of snow conditioner 10 for snow compacting, sheet 32 deflects toward cutter teeth 14 of stationary, unpowered cutter bar 13. To prevent actual contact and damage to sheet 32, a strip 33 of rubberoid material is permanently affixed across the inside of pan 12 from side to side, held in place by fasteners 34.

Although stainless sheet material is believed to be the most desirable for sheet 32 of compactor pan 12, other sheet materials may be utilized without departing from the spirit and basic characteristics of the invention. These materials could conceivably be other .metals, preferably treated, if necessary, to withstand corrosion. Conceivably, a sheet of plastic or reinforced plastic could replace the stainless steel of sheet 32, although considerably less durability would be expected. Also, pan 12 could, at greater expense, be of rigid plastic or metallic construction, premolded or otherwise preformed into installed configuration.

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

What is claimed and desired to be secured by United States Letters Patent is:

1. A vehicle-drawn snow grooming device for conditioning a path of snow for skiing, said device comprising:

a snow tilling apparatus including an elongate tiller frame, an elongate snow cutter bar assembly secured rotatably to the frame and having a multiplicity of outstanding snow cutting teeth, power means to selectively power the cutter bar assembly when desired during operation of the grooming device, and a snow directing apron mounted upon the frame extending over the full length of the cutter bar assembly laterally thereto and the full length thereof, said snow directing apron having a leading edge forward of the cutter bar assembly and a horizontal trailing edge rearward thereof; and an elongate snow compacting member extending the full length of the apron and positioned to span the entire distance from the leading edge of the apron to the trailing edge thereof, said compacting member extending below the cutter bar assembly, so as to bear downwardly upon the snow; and releasable attaching means for selectively securing the snow compacting member in said position upon the snow tilling apparatus, so that the snow grooming device may be used selectively to till or to compact the snow of the path.

2. The snow grooming device of claim 1, wherein the snow compacting member comprises:

a flexible sheet having a leading edge and a trailing edge.

3. The snow grooming device of claim 2, wherein:

the flexible sheet is of material selected from among metallic material and plastic material.

4. The snow grooming device of claim 3, wherein:

the sheet is preformed from front to rear so that at least a portion thereof is convexed downwardly; and the snow compacting member further comprises an elongate pad of rubberoid material secured to the upper face of the sheet in the vicinity of juxtaposed snow cutting teeth of the cutter bar assembly.

5. The snow grooming device of claim 1, further comprising:

snow grooming comb means secured along the trailing edge of the apron extending rearwardly therefrom.

6. The snow grooming device of claim 3, further comprising:

snow grooming comb means secured along the trailing edge of the apron extending rearwardly therefrom.

7. The snow grooming device of claim 4, further comprising:

snow grooming comb means secured along the trailing edge of the apron extending rearwardly therefrom.

8. The snow grooming device of claim 1, wherein the snow compacting member comprises:

a rigid structure of material selected from among metallic material and plastic materials.

9. The snow grooming device of claim 2, wherein the releasable attaching means comprises:

a pair of toggle assemblies each comprising an elongate elastic member, one end thereof being secured to the snow compacting member near its leading edge, the other end of said member carrying an enlarged knob;

a pair of angled brackets each secured to the apron near its leading edge, with a leg thereof outstanding therefrom, said leg having an outwardly opening, knob engaging slot;

a pair of angled brackets secured at opposite ends of the snow compacting member near its trailing edge, each with an upstanding leg with a leg bore therethrough directed laterally to the snow grooming device;

a pair of brackets each secured to the frame of the tiller at opposite ends of the snow compacting member, each with a bore in line with said leg bore; and a pair of pins each manually insertable and removable within one of the pairs of aligned bores, each pin having spring means resisting dislodgment thereof from the bores.

10. The snow grooming device of claim 7, wherein the releasable attaching means comprises:

a pair of toggle assemblies each comprising an elongate elastic member, one end thereof being secured to the snow compacting member near its leading edge, the other end of said member carrying an enlarged knob means;

a pair of angled brackets each secured to the apron near its leading edge, with a leg thereof outstanding therefrom, said leg having an outwardly opening, knob engaging slot;

a pair of angled brackets secured at opposite ends of the snow compacting member near its trailing edge, each with an upstanding leg with a leg bore therethrough directed laterally to the snow grooming device;

a pair of brackets each secured to the frame of the tiller at opposite ends of the snow compacting member, each with a bore in line with said leg bore; and a pair of pins each manually insertable and removable within one of the pairs of aligned bores, each pin having spring means resisting dislodgment thereof from the bores.

* * * * *